US005938183A

United States Patent [19]

Kissick

[11] Patent Number: 5,938,183

[45] Date of Patent: Aug. 17, 1999

[54] BRAKING ASSEMBLY FOR USE ON A HYDRAULIC WINCH

[75] Inventor: Robert M. Kissick, Kansas City, Mo.

[73] Assignee: Hydraulic Power Systems, Inc., North Kansas City, Mo.

[21] Appl. No.: 09/128,801

[22] Filed: Aug. 4, 1998

[51] Int. Cl.[6] ..... B66D 1/08

[52] U.S. Cl. ..... 254/361; 254/266; 91/35

[58] Field of Search ..... 254/361, 266; 91/35, 38

[56] References Cited

U.S. PATENT DOCUMENTS 2,619,073 11/1952 Brooks et al. ..... 91/38
4,836,088 6/1989 Seabaugh ..... 91/436

*Primary Examiner*—Donald P. Walsh
*Assistant Examiner*—Minh-Chau Pham
*Attorney, Agent, or Firm*—Shook, Hardy & Bacon LLP

[57] ABSTRACT

In a hydraulic winch having a clutch assembly for freeing a drum of the winch for free falling rotation, a control system is provided for controlling operation of the clutch assembly. The supply system includes a directional control valve shiftable between a first position in which fluid is supplied to the clutch assembly at a first pressure which maintains the clutch in the disengaged position to allow free fall of the drum, and a second position in which fluid is supplied to the clutch assembly at a second pressure which allows the clutch to return to the engaged position, braking free fall of the drum. A timing element shifts the directional control valve to the second position after fluid has been supplied to the clutch assembly at the first pressure for a predetermined length of time. The timing element is a kick-down sequence valve that is connected directly between the clutch assembly and the directional control valve and that is movable from a flow-preventing position to a flow-permitting position once the fluid supplied to the kick-down sequence valve reaches a predetermined pressure. The kick-down sequence valve in the flow-permitting position supplies pressure to the directional control valve to shift the directional control valve to the second position so that fluid is supplied to the clutch at the second pressure.

4 Claims, 3 Drawing Sheets

BRAKING ASSEMBLY FOR USE ON A HYDRAULIC WINCH

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

This invention relates generally to hydraulic winches, and more particularly to a control system that is used to control the free fall rotation of the drum of a spud winch.

It is known to anchor a barge in a river by releasing an elongated spud or pile that drops from the barge and sinks to the bottom, penetrating the river bed. The spud is suspended from the barge by a cable so that the barge is anchored by the spud to the river bottom, and the cable is spooled on the drum of a hydraulic winch provided on the barge so that the spud can be pulled from the river bottom and raised to release the barge for navigation.

In order to release the spud to anchor the barge, it is conventional to provide the hydraulic winch with a clutch assembly connected between the hydraulic motor of the winch and the drum such that the drum can be disengaged from the motor to rotate freely. By providing this feature in the winch, the spud can be released to free fall to the bottom of the body of water in which the barge is to be anchored, gathering velocity during the free fall to penetrate the river bed by an amount sufficient to anchor the barge in place.

After the spud penetrates the river bottom during an anchoring operation, the velocity of the spud drops off quickly. However, because the free spooling drum continues to rotate under its own momentum, slack is created in the cable, causing tangling or knotting thereof. This effect is referred to as bird nesting, and can damage or ruin the cable. As such, there is a need in the art for a winch having a system for controlling operation of the clutch so that the spud can be released for free fall during anchoring, and rotation of the drum can be subsequently braked to prevent bird nesting of the cable.

BRIEF SUMMARY OF THE INVENTION

It is an object of the present invention to provide a control system for the clutch of a hydraulic winch, wherein each time the clutch is moved to a disengaged position in which the drum of the winch is allowed to free fall, the system times the free fall and automatically re-engages the clutch to brake rotation of the drum after a predetermined delay.

It is another object of the invention to provide such a control system in which the number of system elements necessary to provide the timing and control functions is reduced relative to prior art systems.

In accordance with these and other objects evident from the following description of a preferred embodiment of the invention, a control system is provided for use on a hydraulic winch having a frame, a drum supported on the frame and defining a central longitudinal axis about which the drum rotates, a drive means for driving rotation of the drum, a clutch connected between the drive means and the drum and being movable between an engaged position in which the drive means engages the drum and a disengaged position in which the drum rotates freely, and a hydraulic system for operating the clutch. The control system includes a directional control valve that is shiftable between a first position in which fluid is supplied to the clutch assembly at a first pressure which maintains the clutch in the disengaged position to allow free fall of the drum and a second position in which fluid is supplied to the clutch assembly at a second pressure which allows the clutch to return to the engaged position, braking free fall of the drum. In addition, the system includes a timing means for shifting the directional control valve to the second position after fluid has been supplied to the clutch assembly at the first pressure for a predetermined length of time.

The timing means of the present invention consists solely of a kick-down sequence valve connected directly between the clutch assembly and the directional control valve of the fluid supply means, the kick-down sequence valve being movable from a flow-preventing position to a flow-permitting position once the pressure supplied to the kick-down sequence valve reaches a predetermined pressure. The kick-down sequence valve, in the flow-permitting position, supplies pressure to the directional control valve to shift the directional control valve to the second position so that fluid is supplied to the clutch at the second pressure.

By providing a control system in accordance with the present invention, numerous advantages are realized. For example, by reducing the number of control system elements required to time the disengagement of the clutch, it is possible to more accurately control the free fall of a spud during anchoring of a barge than is possible with conventional systems. In addition, the control system of the present invention is both less complex and less expensive than prior art systems.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
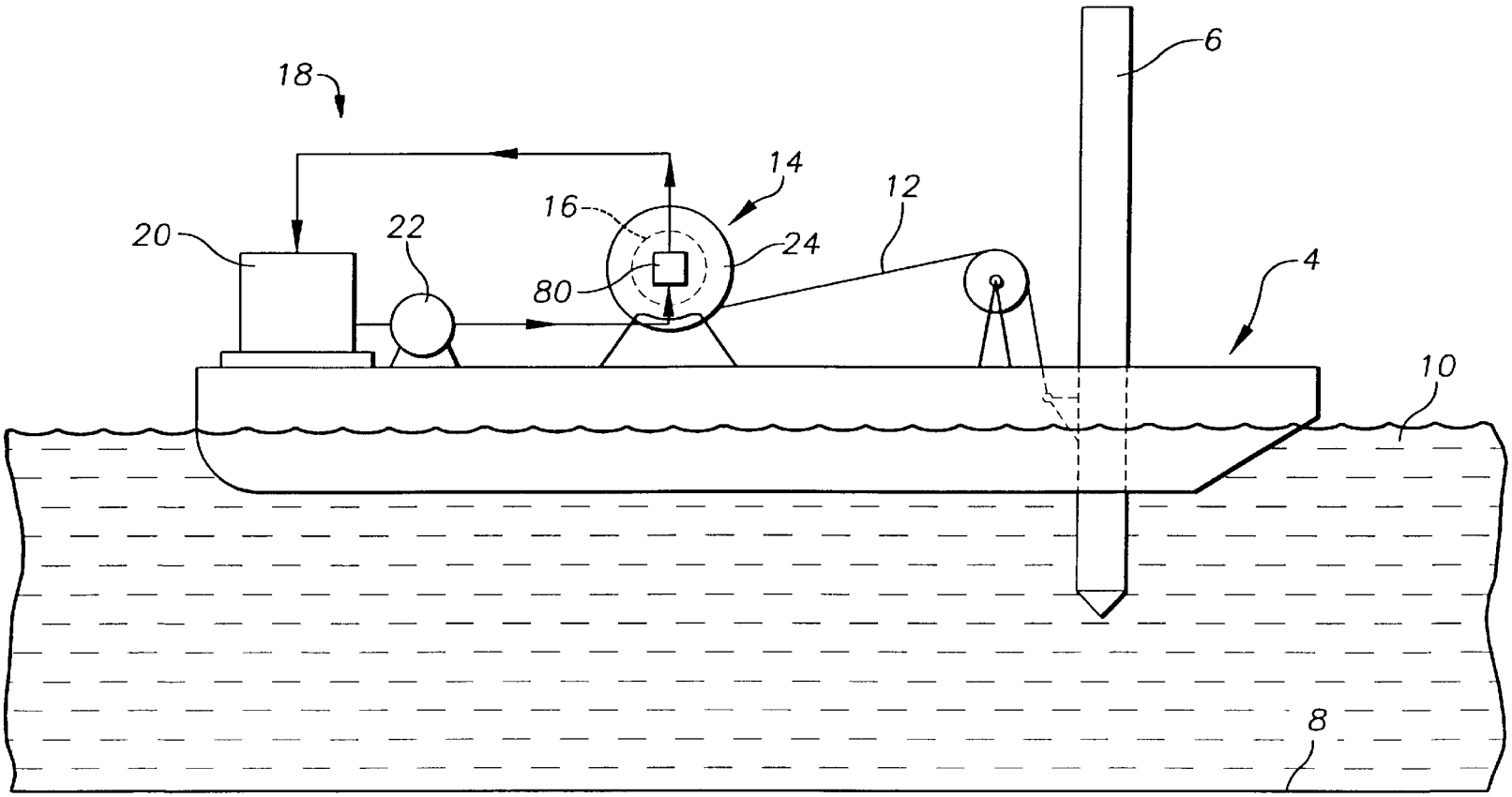
FIG. 1 is a schematic view of a barge having a spud winch constructed in accordance with the preferred embodiment.

A barge 4 is illustrated schematically in FIG. 1, and includes an elongated spud 6 supported on the barge in an upright orientation presenting a pointed bottom end adapted to penetrate the bottom or bed 8 of a body of water 10 when the spud is released from the barge and allowed to sink through the water. A cable or wire rope 12 is connected between the spud and the barge so that when the spud is lodged in the bottom, the barge is anchored in place. The barge 4 also includes a hydraulic winch 14 presenting a drum 16 on which the wire rope 12 is spooled so that the spud can be pulled from the river bottom and raised to release the barge for navigation, as desired. A hydraulic system 18 including a fluid reservoir 20 and one or more pumps 22 is also provided on the barge for operating the winch.

The winch 14 is a conventional planetary hydraulic winch, an example of which is marketed by the Pullmaster Winch Corporation under the model designation M25™. The winch includes a housing 24 that is rigidly secured to a saddle or other mounting structure on the barge 4, and the drum 16 that is supported by the housing for rotation about the central longitudinal axis of the drum. A hydraulic gear motor is also supported by the housing, and is operable to rotate the drum in either direction in order to spool and unspool the wire rope, as desired. The motor is connected to the drum through a clutch that is shiftable between an engaged position in which the drum and motor are operatively interconnected for driving rotation of the drum, and a disengaged position in which the drum is disconnected from the motor and is thus free to rotate under the application of external tensile forces to the cable. If during free spooling rotation of the drum the clutch is moved to the engaged position, further rotation of the drum is braked.

The clutch of the winch 14 is spring biased toward the engaged position, and includes a pilot port that permits hydraulic fluid to be supplied to the clutch to shift it against the bias of the spring to the disengaged position. As such, the default position of the clutch is the engaged position, and it is necessary to maintain sufficient fluid pressure, e.g. between 800 and 1000 psi., to shift the clutch to the disengaged position and keep it there. If the pressure of the fluid supplied to the pilot port of the clutch drops below the pressure necessary to disengage the clutch, the spring biases the clutch back toward the engaged position, braking free-spooling rotation of the drum.

Figure 2:
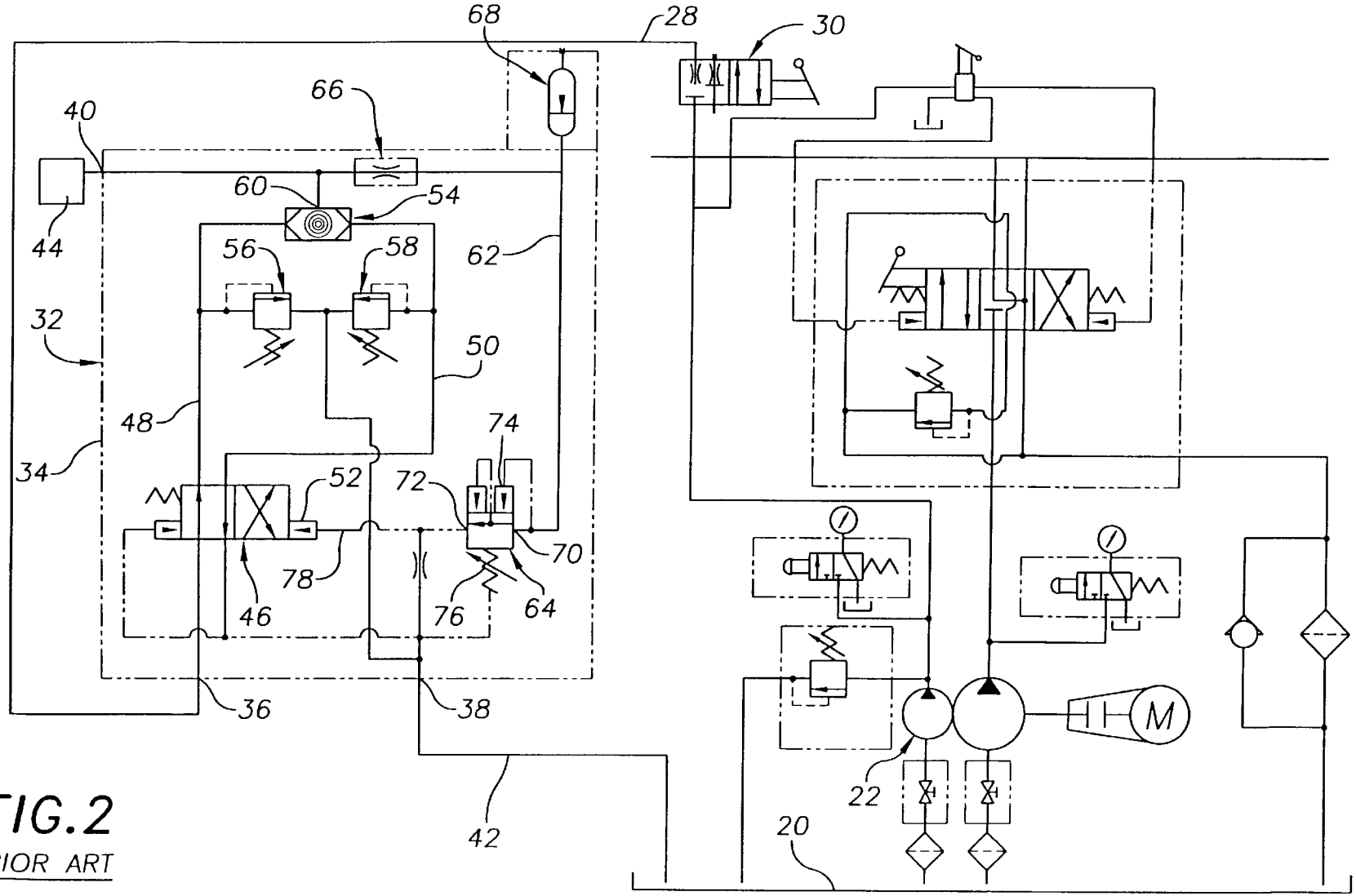
FIG. 2 PRIOR ART
FIG. 2 is a hydraulic schematic view of a winch constructed in accordance with the prior art.

As shown in FIG. 2, the hydraulic system includes a line 28 extending between the pump 22 and the pilot port of the clutch 44, and a directional control valve 30 is positioned in the line 28 to enable the winch operator to selectively shift the clutch between the engaged and disengaged positions. Although this construction of the winch allows the operator of the winch to manually operate the clutch, it does not automatically brake free-spooling rotation of the drum a predetermined period of time after such free spooling is initiated. Thus, when the winch is used on a barge for raising and dropping a spud, a control system is required to time the free fall of the spud in order to brake the spud at the same time that the spud penetrates the bottom of the body of water beneath the barge.

A conventional control system 32 is shown in FIG. 2, for controlling operation of the clutch of the winch, wherein each time the clutch is moved under manual control to the disengaged position, the system times the free-spooling rotation of the drum and automatically re-engages the clutch to brake rotation of the drum after a predetermined delay. The control system 32 includes a housing 34 that can be mounted on the winch between the pilot port of the clutch and the line from the manual control valve, enabling retrofitting of the control system on an existing winch. The housing includes an inlet port 36 to which the line 28 is connected, a first outlet port 38 capable of being connected to a line 42 returning to the reservoir 20 of the hydraulic system, and a second outlet port 40 connected to the pilot port of the clutch 44.

A directional control valve 46, such as a two-position, four-way, pilot-operated directional control valve, is supported by the housing in fluid communication with the inlet 36, and is shiftable between a first position in which fluid entering the inlet is directed to a first line 48 and a second position in which fluid entering the inlet is directed to a second line 50. The control valve is spring biased toward the first position, and includes a pilot port 52 through which pressure can be supplied to shift the valve against the bias of the spring to the second position. An additional pilot port can be provided on the valve opposite the pilot port and through which pressure can be supplied to assist the spring in returning the valve to the first position.

The first and second lines 48, 50 are connected to opposite ends of a shuttle valve 54, and each line is further connected to the reservoir through an adjustable relief valve 56 or 58. The valve 56 in the first line 48 is set at a value, e.g. 1000 psi., which exceeds the pressure required to maintain the clutch in the disengaged position while the relief valve 58 in the second line 50 is set at a value, e.g. 400 psi., which is less than the pressure required to maintain the clutch disengaged. The shuttle valve includes an outlet 60 disposed intermediate the ends, and includes a ball which shifts freely within the valve under the pressure of the fluid passing through the first and second lines 48, 50. As such, the ball is shiftable between a first position in which flow from the first line 48 passes through the valve to the outlet and the ball blocks back flow through the second line 50, and a second position in which flow from the second line passes through the valve to the outlet and the ball blocks back flow through the first line.

The outlet 60 of the shuttle valve 54 is connected directly to the second outlet 40 of the housing to supply fluid pressure from the valve to the pilot port of the clutch 44. In addition, a second line 62 extends between the shuttle valve and a kick-down sequence valve 64. The second line also includes an adjustable needle valve 66 and an accumulator 68. The needle valve 66 provides an orifice in the line for restricting the flow of fluid between the shuttle valve and the kick-down sequence valve, delaying the build-up of pressure in the fluid supplied to the kick-down sequence valve. The accumulator 68 serves a similar function by allowing fluid to accumulate therein up to a predetermined pressure. Once this pressure is reached, the pressure of the fluid supplied to the kick-down sequence valve rises to meet the pressure at the outlet of the needle valve.

The kick-down sequence valve 64 includes an inlet 70 connected to the line, an outlet 72 connectable to the pilot port of the directional control valve, and a pilot port 74 connected to the inlet 70 of the valve for sensing the pressure in the line 62 and opening the valve 64 when the pressure reaches a preset pressure. An additional pilot port is provided on the valve and receives pressure from the line passing through the valve to maintain the valve in the open position so long as some minimum pressure is maintained in the line. A spring 76 opposes the pressure supplied to the pilot ports, and is adjustable to preset the pressure at which the valve kicks down to the open position. The spring 76 is adjustable to allow this kick-down pressure to be adjusted. A drain line is provided in the line 78 between the kick-down sequence valve and the pilot port 52 of the directional control valve 46 in order to relieve pressure in the line, and a restricted orifice is positioned in the drain line to allow drainage while maintaining sufficient pressure in the line to shift the directional control valve.

In order to employ the conventional control system 32 in anchoring a barge to a river bottom or the like, a barge operator first powers the winch in a first direction to lower the spud into contact with the bottom of the river. Thereafter, the operator powers the winch in the opposite direction to raise the spud a predetermined distance of, e.g. 10 feet. With the spud suspended at this height above the bed, the operator then actuates the free fall control lever 30, supplying fluid under a pressure of, e.g. 1000 psi. to the inlet 36 of the control system housing.

Because the directional control valve 46 is biased to the first position, as shown in FIG. 2, the high-pressure fluid passes into the line 48, through the shuttle valve 54, and to the inlet of the clutch 44, moving the clutch to the disengaged position. With the clutch disengaged, the drum is free to rotate under the tensile force exerted on the wire rope by the spud, and the spud sinks back to the river bed, gathering velocity along the way.

At the same time that fluid is supplied to the clutch, it is also supplied through the needle valve 66 to the accumulator 68, and there collects until a predetermined pressure is reached. Once the accumulator accepts no further fluid, the pressure in the line 62 builds until a preset kick-down pressure of, e.g. 800 psi. is reached. When this occurs, the valve 64 is kicked down to the flow-permitting position, allowing pressure to the pilot port 52 of the directional control valve, shifting the valve to the second position.

With the control valve 46 in the second position, fluid supplied to the housing is diverted through the second line 50, and any pressure exceeding a relatively low value, e.g. 400 psi., is relieved and returned to the reservoir through the line 42. The pressure in the line also operates to shift the ball of the shuttle valve 54 to the left, supplying fluid under the relatively low pressure to the pilot port of the clutch 44. However, because the relatively low pressure of the fluid supplied to the clutch is insufficient to offset the force of the spring biasing the clutch toward the engaged position, the clutch is engaged, braking further rotation of the drum.

The entire length of time that elapses between actuation of the manual control valve 30 and braking of the free fall of the spud is dictated by the construction of the control system, and primarily by the needle valve 66, the accumulator 68 and the kick-down sequence valve 64. As such, these three elements of the system, each of which is manually adjustable to vary the delay contributed by that element, form a timing means for re-engaging the clutch to brake the drum after the clutch has been disengaged for a predetermined length of time. An operator attempting to adjust the delay must deal with three different adjustments, and any adjustment to one of the elements of the timing means may counteract an adjustment made to another of the elements. This complexity renders the conventional system difficult to operate, and increases its cost of manufacture.

Figure 3:
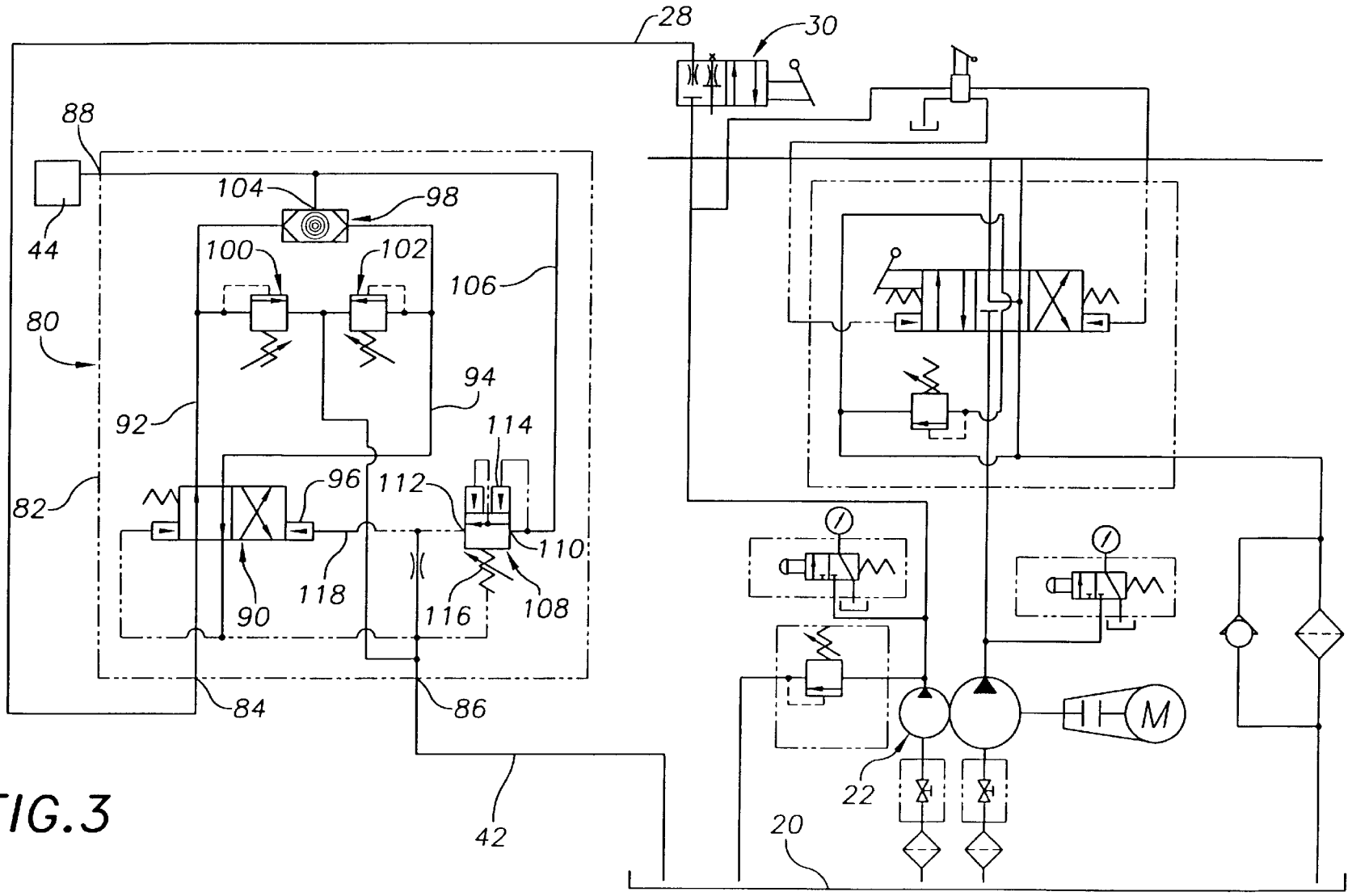
FIG. 3 is a hydraulic schematic view of a winch constructed in accordance with the preferred embodiment.

A control system 80 constructed in accordance with the preferred embodiment is shown in FIG. 3, and is operable for controlling operation of the clutch 44 of the winch, wherein each time the clutch is moved under manual control to the disengaged position, the system times the free-spooling rotation of the drum and automatically re-engages the clutch to brake rotation of the drum after a predetermined delay. The control system 80 includes a housing 82 that can be attached to the winch between the pilot port of the clutch 44 and the line 28 from the manual control valve 30, enabling retrofitting of the control system on an existing winch. The housing 82 includes an inlet port 84 to which the line is connected, a first outlet port 86 capable of being connected to the line 42 returning to the reservoir of the hydraulic system, and a second outlet port 88 connected to the pilot port of the clutch 44.

A directional control valve 90, such as a two-position, four-way, pilot-operated directional control valve, is supported by the housing in fluid communication with the inlet 84, and is shiftable between a first position, shifted to the right as shown in FIG. 3, in which fluid entering the inlet is directed to a first line 92 and a second position, shifted to the left from the position shown in FIG. 3, in which fluid entering the inlet is directed to a second line 94. The control valve 90 is spring biased toward the first position, and includes a pilot port 96 through which pressure can be supplied to shift the valve against the bias of the spring to the second position. An additional pilot port can be provided on the valve opposite the pilot port and through which pressure can be supplied to assist the spring in returning the valve to the first position.

The first and second lines 92, 94 are connected to opposite ends of a shuttle valve 98, and each line is further connected to the reservoir through an adjustable relief valve 100 or 102. The valve 100 in the first line 92 is set at a value, e.g. 1000 psi., which exceeds the pressure required to maintain the clutch in the disengaged position, and the relief valve 102 in the second line 94 is set at a value, e.g. 400 psi., which is less than the pressure required to maintain the clutch disengaged. The shuttle valve 98 includes an outlet 104 disposed intermediate the ends, and includes a ball or the like which shifts freely within the valve under the pressure of the fluid passing through the first and second lines. As such, the ball is shiftable between a first position in which flow from the first line passes through the valve to the outlet and the ball blocks back flow through the second line, and a second position in which flow from the second line passes through the valve to the outlet and the ball blocks back flow through the first line.

The outlet 104 of the shuttle valve is connected directly to the second outlet 88 of the housing to supply pressure from the valve to the pilot port of the clutch 44. In addition, a second line 106 extends directly between the shuttle valve 98 and a kick-down sequence valve 108. No adjustable needle valve or accumulator is provided in the line 106 between the shuttle valve and the kick-down sequence valve, and the timing means provided for timing the braking of the drum after the clutch has been disengaged for a predetermined length of time consists solely of the kick-down sequence valve.

Preferably, the kick-down sequence valve 108 includes an inlet 110 connected to the line 106, an outlet 112 connectable to the pilot port 96 of the directional control valve 90, and a pilot port 114 connected to the inlet of the valve for sensing the pressure in the line and opening the valve when the pressure reaches a preset pressure. An additional pilot port is provided on the valve and receives pressure from the line through the valve to maintain the valve in the open position so long as some minimum pressure is maintained in the line. A spring 116 opposes the pressure supplied to the pilot ports, and is adjustable to preset the pressure at which the valve 108 kicks down to the open position. The spring 116 is adjustable to allow this kick-down pressure to be adjusted such that the delay between disengagement of the clutch and re-engagement thereof can be varied, as desired, by making a single adjustment.

A drain line is provided in the line 118 between the kick-down sequence valve 108 and the pilot port 96 of the directional control valve 90 in order to relieve pressure in the line, and a restricted orifice is positioned in the line to allow drainage while maintaining sufficient pressure in the line to shift the directional control valve.

In order to employ the control system in anchoring a barge to a river bottom or the like, a barge operator first powers the winch in a first direction to lower the spud into contact with the bottom of the river. Thereafter, the operator powers the winch in the opposite direction to raise the spud a predetermined distance of, e.g. 10 feet. With the spud suspended at this height above the bed, the operator then actuates the free fall control lever 30, supplying fluid under a pressure of, e.g. 1000 psi. to the inlet 84 of the control system housing.

Because the directional control valve 90 is biased to the first position, as shown in FIG. 3, the fluid passes into the line 92, through the shuttle valve 98, and to the inlet of the clutch 44, moving the clutch to the disengaged position. With the clutch disengaged, the drum is free to rotate under the tensile force exerted on the cable by the spud, and the spud sinks back to the river bed, gathering velocity along the way.

At the same time that pressure is supplied to the clutch, it is also supplied through the line 106 to the kick-down sequence valve 108 which remains in the flow-preventing position until the preset pressure of, e.g. 800 psi. is reached. When this occurs, the valve 108 is kicked down to the flow-permitting position, allowing pressure to the pilot port 96 of the directional control valve 90, shifting the valve to the left into the second position.

With the control valve 90 in the second position, fluid supplied to the housing is diverted through the second line 94, and any pressure exceeding a relatively low value, e.g. 400 psi., is relieved and returned to the reservoir through the line 42. The pressure in the line 94 also operates to shift the ball of the shuttle valve 98 to the left, supplying fluid under the relatively low pressure to be supplied to the clutch 44. However, because the relatively low pressure of the fluid supplied to the clutch is insufficient to offset the force of the spring biasing the clutch toward the engaged position, the clutch is engaged, braking further rotation of the drum.

The entire length of time that elapses between actuation of the manual control valve 30 and braking of the free fall of the spud is dictated by the construction of the control system, and primarily by the kick-down sequence valve 108. As such, this single element of the system forms a timing means for shifting the directional control valve to the left position after the clutch has been disengaged for a predetermined length of time.

If the timing of the system is improper for a particular application, the operator simply adjusts the spring 116 of the kick-down sequence valve 108 to either increase or decrease the preset pressure at which kick-down of the valve is initiated. If the preset pressure is increased, the delay will be longer, and if the kick-down pressure is reduced, the delay time will be shorter. However, there is no guess work in making these adjustments, and only one point of adjustment exists such that the operator cannot make one adjustment to one system element that possibly offsets an adjustment made to another element of the system, as is the case with the known construction. If desired, indicia can be placed on the housing at the point of adjustment to indicate what adjustment is necessary to prolong or reduce the delay provided by the timing means, facilitating use of the system, and reducing the likelihood of mistakes being made.

Although the invention has been described with reference to the preferred embodiment illustrated in the attached drawing FIGS., it is noted that substitutions may be made and equivalents employed herein without departing from the scope of the invention as recited in the claims.

I claim:

1. A control system for use on a hydraulic winch having a frame, a drum supported on the frame and defining a central longitudinal axis about which the drum rotates, a drive means for driving rotation of the drum, a clutch connected between the drive means and the drum and being movable between an engaged position in which the drive means engages the drum and a disengaged position in which the drum rotates freely, and a hydraulic system for operating the clutch, the hydraulic system including a fluid reservoir, a shiftable control valve including an inlet connected to the fluid reservoir and an outlet connected to the control system, the shiftable control valve being movable to a first position in which fluid is permitted to flow from the inlet to the outlet of the control valve to disengage the clutch and to allow free-falling rotation of the drum, the control system comprising:

a directional control valve shiftable between first and second positions, and including a fluid inlet port connected to the outlet port of the shiftable control valve and first and second fluid outlet ports connected to the clutch assembly, the fluid inlet port being connected to the first fluid outlet port when the directional control valve is in the first position and to the second fluid outlet port when in the second position, the directional control valve further including a pilot port for controlling the position of the directional control valve;

a first pressure relief valve including an inlet connected to the first fluid outlet port of the directional control valve and an outlet connected to the reservoir, the first pressure relief valve relieving pressure from the first fluid outlet port above a first preset pressure;

a second pressure relief valve including an inlet connected to the second fluid outlet port of the directional control valve and an outlet connected to the reservoir, the second pressure relief valve relieving pressure from the second fluid outlet port above a second preset pressure;

a shuttle valve including first and second inlet ports connected to the first and second fluid outlet ports of the directional control valve, and an outlet port connected to the clutch assembly, the shuttle valve being shiftable between a first position in which the first inlet port of the shuttle valve is connected to the clutch assembly, and a second position in which the second inlet port is connected to the clutch assembly; and a timing means for shifting the directional control valve to the second position after fluid has been supplied to the clutch assembly at the first pressure for a predetermined length of time, the timing means consisting solely of a kick-down sequence valve including an inlet port and a pilot port connected to the outlet port of the shuttle valve, and an outlet port connected to the pilot port of the directional control valve, the kick-down sequence valve being shiftable between an initial position in which the inlet port of the kick-down sequence valve is disconnected from the pilot port of the directional control valve, and a second position in which the inlet port of the kick-down sequence valve is connected to the pilot port of the directional control valve to shift the directional control valve to the second position so that fluid is supplied to the clutch at the second pressure.

2. A control system as recited in claim 1, wherein the second pressure relief valve relieves pressure above 1000 psi.

3. A control system as recited in claim 1, wherein the first pressure relief valve relieves pressure above about 400 psi.

4. A control system as recited in claim 1, wherein the predetermined pressure at which the kick-down sequence valve moves from the flow-preventing position to the flow-permitting position is about 800 psi.

* * * * *